US010504413B2

(12) United States Patent
Lee et al.

(10) Patent No.: US 10,504,413 B2
(45) Date of Patent: Dec. 10, 2019

(54) DISPLAY APPARATUS AND METHOD OF DRIVING THE SAME

(71) Applicant: Samsung Display Co., Ltd., Yongin-si, Gyeonggi-do (KR)

(72) Inventors: Hyojin Lee, Yongin-si (KR); Jihye Kim, Hwaseong-si (KR); Jae-Hyeon Jeon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 101 days.

(21) Appl. No.: 15/804,988

(22) Filed: Nov. 6, 2017

(65) Prior Publication Data

US 2018/0137803 A1 May 17, 2018

(30) Foreign Application Priority Data

Nov. 15, 2016 (KR) ..... 10-2016-0151993

(51) Int. Cl.
*G09G 3/20* (2006.01)

(52) U.S. Cl.
CPC ... *G09G 3/2092* (2013.01); *G09G 2300/0819* (2013.01); *G09G 2310/0202* (2013.01); *G09G 2310/0218* (2013.01); *G09G 2310/08* (2013.01); *G09G 2330/021* (2013.01); *G09G 2330/023* (2013.01)

(58) Field of Classification Search
CPC ..... G09G 3/2092; G09G 3/3275; G09G 3/3685–3688; G09G 2310/0218
See application file for complete search history.

(56) References Cited

U.S. PATENT DOCUMENTS

2010/0146175 A1* 6/2010 Choe ..... G09G 3/2096 710/110

FOREIGN PATENT DOCUMENTS

| | | | |
|---|---|---|---|
| KR | 10-2014-0141479 | A | 12/2014 |
| KR | 10-2015-0060360 | A | 6/2015 |
| KR | 10-2016-0055613 | A | 5/2016 |
| KR | 10-2016-0087484 | A | 7/2016 |

* cited by examiner

*Primary Examiner* — Michael Pervan
(74) *Attorney, Agent, or Firm* — Lewis Roca Rothgerber Christie LLP

(57) ABSTRACT

A display apparatus includes a display panel including a plurality of data lines and a plurality of scan lines crossing the plurality of data lines, the plurality of data lines including a plurality of first data lines and a plurality of second data lines, a scan driver configured to sequentially output a plurality of scan signals to the plurality of scan lines, a first data driver circuit configured to sequentially output a plurality of first data signals to the plurality of first data lines, and a second data driver circuit configured to sequentially output a plurality of second data signals to the plurality of second data lines based on a feedback signal received from the first data driver circuit.

11 Claims, 6 Drawing Sheets

DISPLAY APPARATUS AND METHOD OF DRIVING THE SAME

CROSS-REFERENCE TO RELATED APPLICATION

This application claims priority to, and the benefit of, Korean Patent Application No. 10-2016-0151993, filed on Nov. 15, 2016, which is hereby incorporated by reference for all purposes as if fully set forth herein.

BACKGROUND

1. Field

Aspects of the inventive concept relate to a display apparatus and a method of driving the display apparatus.

2. Description of the Related Art

Recently, various flat panel display devices having reduced weight and volume in comparison to Cathode Ray Tubes (CRTs), have been developed. The flat panel display devices include a liquid crystal display (LCD) device, a field emission display (FED) device, a plasma display panel (PDP), an organic light emitting display (OLED) device, etc.

The OLED device has advantages such as rapid response speed and low power consumption, because the OLED device among the flat panel display devices displays an image using organic light emitting diodes that emit light based on recombination of electrons and holes.

SUMMARY

Aspects of embodiments of the inventive concept are directed toward a display apparatus capable of compensating for a scan delay.

Aspects of embodiments of the inventive concept are directed to a method of driving the display apparatus.

According to some exemplary embodiments of the inventive concept, there is provided a display apparatus including: a display panel including a plurality of data lines and a plurality of scan lines crossing the plurality of data lines, the plurality of data lines including a plurality of first data lines and a plurality of second data lines; a scan driver configured to sequentially output a plurality of scan signals to the plurality of scan lines; a first data driver circuit configured to sequentially output a plurality of first data signals to the plurality of first data lines; and a second data driver circuit configured to sequentially output a plurality of second data signals to the plurality of second data lines based on a feedback signal received from the first data driver circuit.

In some embodiments, the display apparatus further includes a timing controller, wherein each of the first and second data driver circuits includes a plurality of output channels, and the timing controller is configured to provide each of the first and second data driver circuits with a delay difference between output signals of a first output channel and a last output channel from among the plurality of output channels.

In some embodiments, the first data driver circuit is configured: to generate a first internal clock signal based on an external clock signal, to sequentially output a plurality of first data signals based on the first internal clock signal and the delay difference, and to supply the second data driver circuit with the feedback signal corresponding to an output timing of a last first data signal from among the plurality of first data signals.

In some embodiments, the second data driver circuit is configured: to generate a second internal clock signal delayed from an external clock signal based on the feedback signal, to sequentially output a plurality of second data signals based on the second internal clock signal and the delay difference, and to output the feedback signal corresponding to an output timing of a last second data signal from among the plurality of second data signals.

In some embodiments, the first data driver circuit is configured: to generate a first internal clock signal based on an external clock signal, to sequentially output a plurality of first data signals based on the first internal clock signal and the delay difference, to generate a second internal clock signal delayed from the first internal clock signal based on the delay difference, and to output the feedback signal as the second internal clock signal.

In some embodiments, the second data driver circuit is configured: to sequentially output a plurality of second data signals based on the second internal clock signal, to generate a third internal clock signal delayed from the second internal clock signal based on the delay difference, and to output the feedback signal as the third internal clock signal.

In some embodiments, each of the first and second data driver circuits includes: a clock generator configured to generate an internal clock signal; and a data processor configured to convert image data into a data signal that is an analog voltage.

In some embodiments, a last output channel from among a plurality of output channels of the first data driver circuit is configured to output a data signal at an output timing that is the same as that of a first output channel from among a plurality of output channels of the second data driver circuit.

According to some exemplary embodiments of the inventive concept, there is provided a method of driving a display apparatus that includes a plurality of data lines and a plurality of scan lines crossing the plurality of data lines, the method including: outputting a scan signal to the plurality of scan lines; sequentially outputting a plurality of first data signals to a plurality of first data lines by a first data driver circuit; and sequentially outputting a plurality of second data signals to a plurality of second data lines, based on a feedback signal received from the first data driver circuit, by a second data driver circuit, the plurality of second data signals being delayed from the plurality of first data signals.

In some embodiments, the method of claim further includes: supplying each of the first and second data driver circuits with a delay difference between output signals of a first output channel and a last output channel from among a plurality of output channels, wherein each of the first and second data driver circuits includes a plurality of output channels.

In some embodiments, the method of claim further includes: generating a first internal clock signal, by the first data driver circuit, based on an external clock signal; sequentially outputting a plurality of first data signals based on the first internal clock signal and the delay difference; and supplying, to the second data driver circuit, the feedback signal corresponding to an output timing of a last first data signal from among the plurality of first data signals.

In some embodiments, the method of claim further includes: generating a second internal clock signal, by the second data driver circuit, that is delayed from an external clock signal based on the feedback signal; sequentially outputting a plurality of second data signals based on the second internal clock signal and the delay difference; and outputting the feedback signal corresponding to an output timing of a last second data signal from among the plurality of second data signals.

In some embodiments, the method of claim further includes: generating a first internal clock signal, by the first data driver circuit, based on an external clock signal; sequentially outputting a plurality of first data signals based on the first internal clock signal and the delay difference; generating a second internal clock signal delayed from the first internal clock signal based on the delay difference; and outputting the second internal clock signal as the feedback signal to the second data driver circuit.

In some embodiments, the method of claim further includes: sequentially outputting a plurality of second data signals based on the second internal clock signal;

generating a third internal clock signal delayed from the second internal clock signal based on the delay difference; and outputting the feedback signal as the third internal clock signal.

In some embodiments, a last output channel from among a plurality of output channels of the first data driver circuit is configured to output a data signal at an output timing that is the same as that of a first output channel from among a plurality of output channels of the second data driver circuit.

According to some embodiments of the inventive concept, in a display apparatus with a high-resolution, a plurality of data driver circuits may be configured to sequentially output all data signals through all output channels of the plurality of data driver circuits. Thus, a data charge margin, according to the RC delay of the scan signal in the display apparatus with a high-resolution, may increase.

BRIEF DESCRIPTION OF THE DRAWINGS

The above and other features and aspects of the inventive concept will become more apparent by describing in detailed exemplary embodiments thereof with reference to the accompanying drawings, in which.

DETAILED DESCRIPTION

Hereinafter, the inventive concept will be explained in detail with reference to the accompanying drawings.

Figure 1:
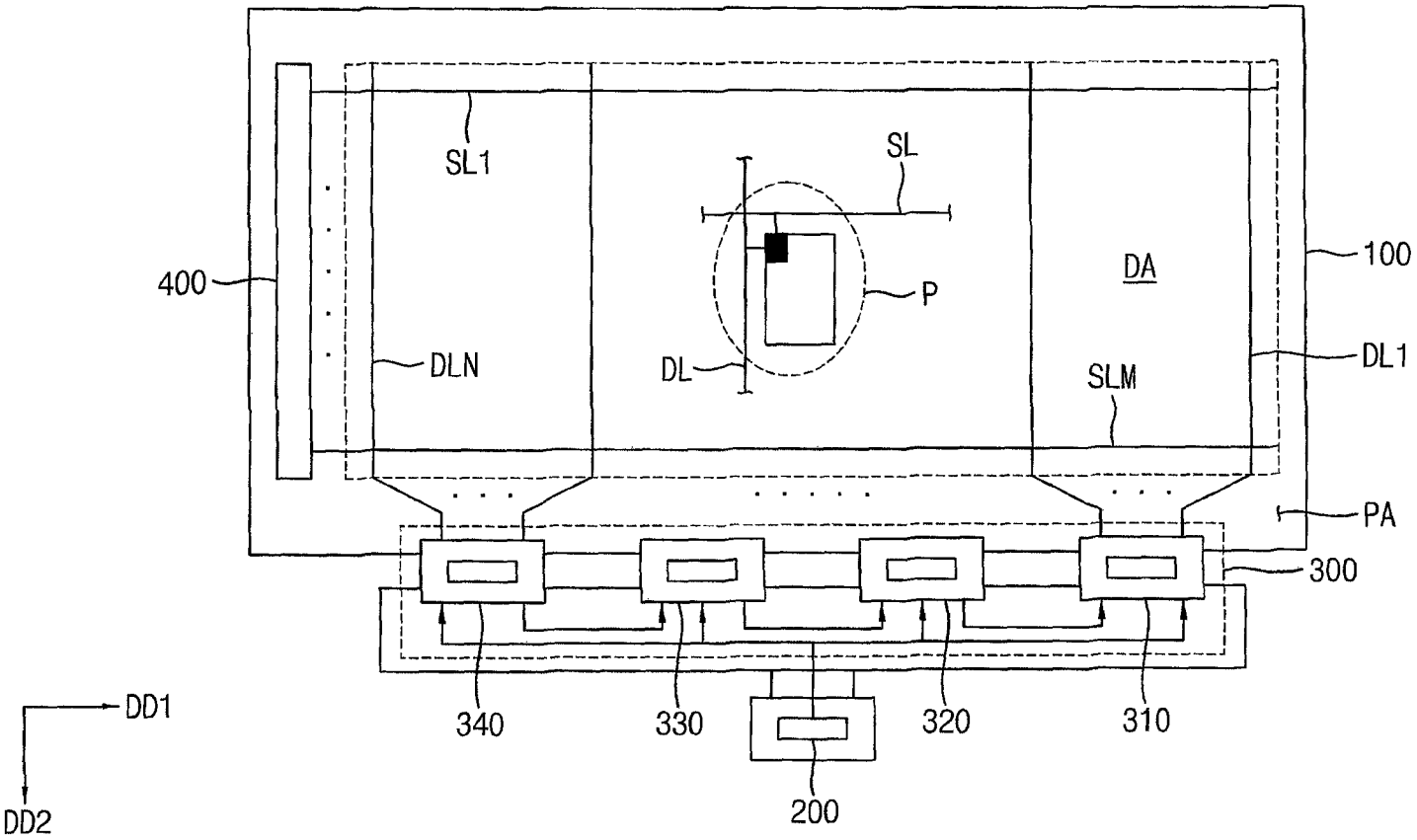
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus may include a display panel 100, a timing controller 200, a data driver 300, and a scan driver 400.

The display panel 100 may include a display area DA and a peripheral area PA surrounding the display area DA.

The display panel 100 may include a plurality of data lines DL1, . . . , DLN, a plurality of scan lines SL1, . . . , SLM and a plurality of pixels P in the display area DA (wherein, 'N' and 'M' are natural numbers).

The data lines DL1, . . . , DLN extend in a second direction DD2 and are arranged in a first direction DD1 crossing the second direction DD2. The data lines DL1, . . . , DLN are configured to transfer data signals to the pixels P.

The scan lines SL1, . . . , SLM extend in the first direction DD1 and are arranged in second direction DD2. The scan lines SL1, . . . , SLM are configured to sequentially transfer scan signals to the pixels P.

Each of the pixels P may include a pixel circuit. The pixel circuit may include a plurality of transistors, a display element, and a storage capacitor. The plurality of transistors may be connected to a data line and a scan line, the display element may be electrically connected to the plurality of transistors, and the storage capacitor may be electrically connected to the display element. The display element may include a liquid crystal capacitor and an organic light emitting diode.

The timing controller 200 is configured to receive image data and a synchronizing signal from an external graphic apparatus. The timing controller 200 is configured to provide the data driver 300 with the image data. The timing controller 200 is configured to generate a data control signal for driving the data driver 300 and a scan control signal for driving the scan driver 400 using the synchronizing signal. The data control signal may include an external clock signal and a delay difference. The external clock signal may be a main clock signal, which controls an operation of the data driver 300. The delay difference may be a delay difference between a first output signal of a first output channel and a last output signal of a last output channel of the data driver circuit, and may be calculated based on an RC delay of a scan signal applied to the scan line.

The data driver 300 may include a plurality of data driver circuits 310, 320, 330, and 340.

When an RC delay compensation mode, in which the RC delay of the scan signal is compensated, is turned on, the data driver 300 is configured to sequentially delay the plurality of data signals of the plurality of output channels and to sequentially output delayed plurality of data signals. Thus, a data charge margin with respect to the RC delay of the scan signal may increase.

However, when the RC delay compensation mode is turned off, the data driver 300 is configured to concurrently (e.g., simultaneously) output the plurality of data signals of the plurality of output channels at a same or substantially same period.

When the RC delay compensation mode is in an ON state, the plurality of data driver circuits 310, 320, 330, and 340 is configured to receive the delay difference from the timing controller 200. Each of the plurality of data driver circuits 310, 320, 330, and 340 is configured to sequentially output the plurality of data signals through the plurality of output channels. In addition, a current data driver circuit is configured to sequentially output a plurality of data signals delayed from a plurality of data signals outputted from the previous data driver circuit, based on a feedback signal received from a previous data driver circuit.

Therefore, the data driver circuits 310, 320, 330, and 340 are configured to sequentially output first to n-th data signals to first to n-th data lines DL1, . . . , DLN. Thus, the data charge margin, according to the RC delay of the scan signal, may increase.

The scan driver 400 is configured to generate a plurality of scan signals based on the scan control signal received from the timing controller 200, and to sequentially provide the plurality of scan lines SL1, . . . , SLM to the plurality of scan signals.

According to the exemplary embodiment, a plurality of data driver circuits is configured to provide data signals, which are sequentially delayed corresponding to the RC delay of the scan signal, to the data lines and thus, the data charge margin may be increased.

Figure 2:
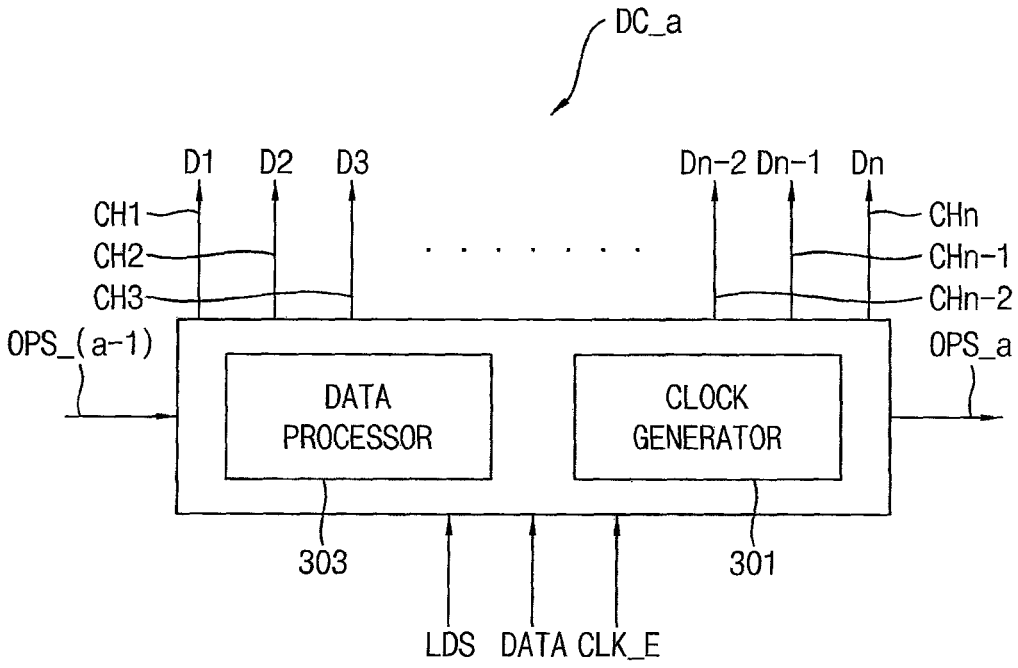
FIG. 2 is a block diagram illustrating a data driving circuit according to an exemplary embodiment of the inventive concept.

FIG. 2 is a block diagram illustrating a data driving circuit according to an exemplary embodiment of the inventive concept.

Referring to FIGS. 1 and 2, the data driver 300 may include a plurality of data driver circuits.

The data driver circuit DC_a may include a clock generator 301 and a data processor 303.

The data driver circuit DC_a is configured to receive image data DATA, an external synchronizing signal CLK_E and a delay difference LDS from the timing controller 200 using a set or predetermined interface mode, such as an LVDS (Low-voltage differential signaling) mode. Hereinafter, the external synchronizing signal may be referred to as an external clock signal. The delay difference LDS may be determined by the timing controller 200.

When the data driver circuit DC_a is a first data driver circuit among the plurality of data driver circuits, the data driver circuit DC_a may be configured to receive the image data DATA, the external clock signal CLK_E, and the delay difference LDS from the timing controller 200. The data driver circuit DC_a may be configured not to receive a feedback signal that is an output timing signal OPS_(a−1) outputted from a previous data driver circuit (wherein, 'a' is a natural number).

The clock generator 301 is configured to restore the external clock signal CLK_E and to generate an internal clock signal CLK_a using the external clock signal CLK_E.

The data processor 303 is configured to convert the image data DATA into a data signal, which is an analog voltage.

The data processor 303 is configured to determine output timings of the plurality of data signals D1, D2, D3, . . . , Dn−2, Dn−1, and Dn based on the internal clock signal CLK_a and the delay difference LDS.

The data processor 303 is configured to sequentially output the plurality of data signals D1, D2, D3, . . . , Dn−2, Dn−1, and Dn to the plurality of data lines, which is connected to the plurality of output channels CH1, CH2, CH3, . . . , CHn−2, CHn−1, and CHn, according to the determined output timings.

For example, the data processor 303 is configured to time-share a delay period corresponding to the delay difference LDS by a number of the output channels and to sequentially provide the plurality of data signals D1, D2, D3, . . . , Dn−2, Dn−1, and Dn at the time-shared output timings.

The data driver circuit DC_a is configured to generate an output timing signal OPS_a corresponding to the output timing of a last n-th output channel, and to provide a next data driver circuit with the output timing signal OPS_a.

However, when the data driver circuit DC_a is not the first data driver circuit among the plurality of data driver circuits, the data driver circuit DC_a may be configured to receive the image data DATA, the external clock signal CLK_E, and the delay difference LDS from the timing controller 200. In addition, the data driver circuit DC_a may be configured to receive an output timing signal OPS_(a−1) that is the feedback signal outputted from a previous data driver circuit. The output timing signal OPS_(a−1) may correspond to an output timing of a last output channel of the previous data driver circuit.

The clock generator 301 is configured to restore the external clock signal CLK_E, and to generate an internal clock signal CLK_a delayed from the external clock signal CLK_E clock signal based on the output timing signal OPS_(a−1).

The data processor 303 is configured to convert the image data DATA into the data signal, which is an analog voltage.

The data processor 303 is configured to determine output timings of the plurality of data signals D1, D2, D3, . . . , Dn−2, Dn−1, and Dn based on the internal clock signal CLK_a and the delay difference LDS.

The data processor 303 is configured to sequentially output the plurality of data signals D1, D2, D3, . . . , Dn−2, Dn−1, and Dn to the plurality of data lines, which is connected to the plurality of output channels CH1, CH2, CH3, . . . , CHn−2, CHn−1, and CHn according to the determined output timings.

For example, the data processor 303 is configured to time-share a delay period corresponding to the delay difference LDS by a number of the output channels and to sequentially provide the plurality of data signals D1, D2, D3, . . . , Dn−2, Dn−1, and Dn at the time-shared output timings.

The data driver circuit DC_a may be configured to generate an output timing signal OPS_a corresponding to the output timing of a last n-th output channel, and to provide a next data driver circuit with the output timing signal OPS_a.

Figure 3:
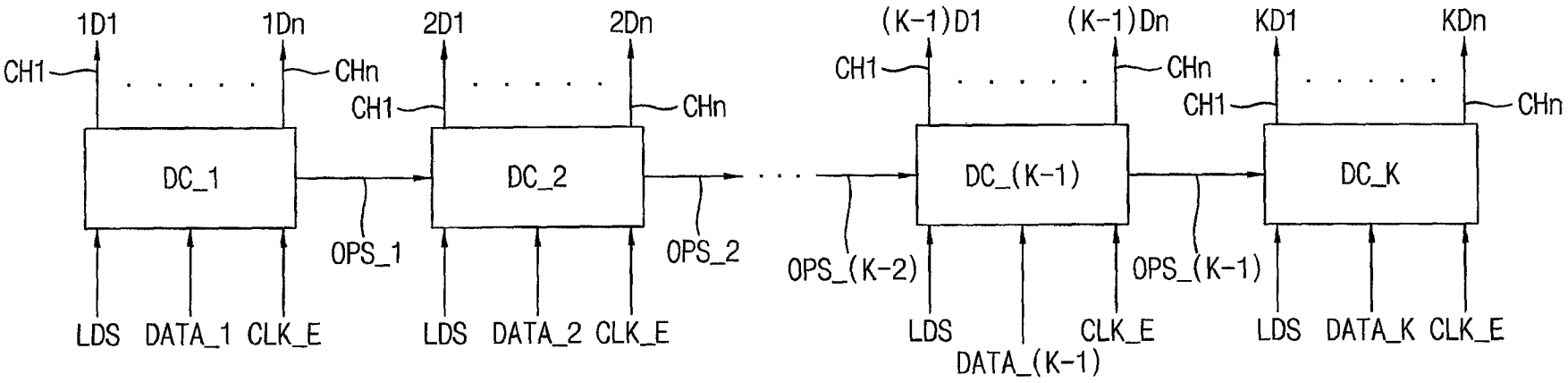
FIG. 3 is a block diagram illustrating a plurality of data driving circuits according to an exemplary embodiment of the inventive concept.
Figure 4:
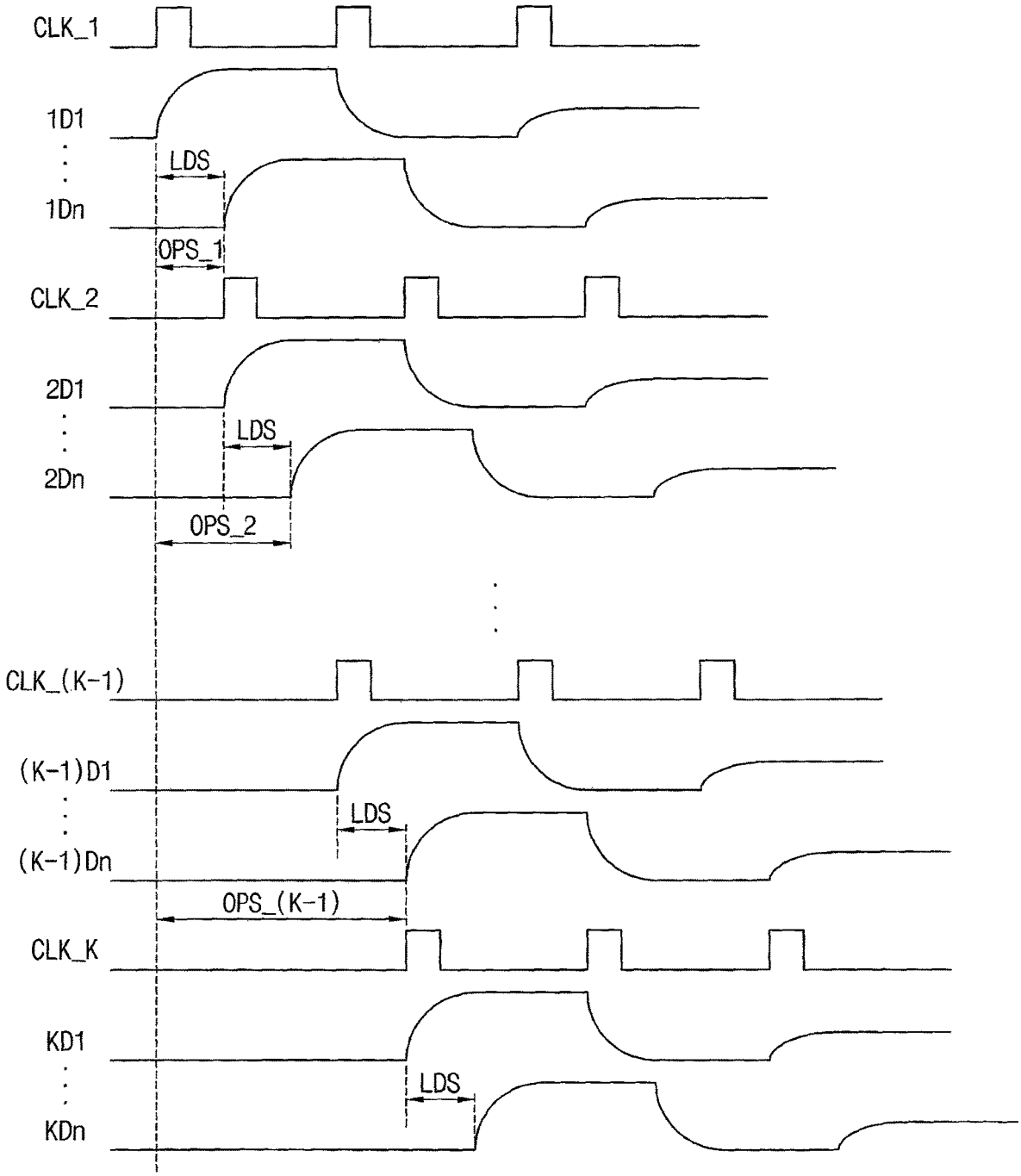
FIG. 4 is a waveform diagram illustrating a method of driving display apparatus according to an exemplary embodiment of the inventive concept.

FIG. 3 is a block diagram illustrating a plurality of data driving circuits according to an exemplary embodiment of the inventive concept. FIG. 4 is a waveform diagram illustrating a method of driving display apparatus according to an exemplary embodiment of the inventive concept.

Referring to FIGS. 3 and 4, the display apparatus may include a plurality of data driver circuits DC_1, DC_2, . . . , DC_(K−1), and DC_K (wherein, 'K' is a natural number).

When the RC delay compensation mode is in an OFF state, the plurality of data driver circuits DC_1, DC_2, . . . , DC_(K−1), and DC_K is configured to receive image data DATA and an external clock signal CLK_E from the timing controller 200.

Each of the plurality of data driver circuits DC_1, DC_2, . . . , DC_(K−1), and DC_K is configured to generate an internal clock signal restoring the external clock signal CLK_E, and to concurrently (e.g., simultaneously) output the plurality of data signals (e.g., at a same time or at a same output timing) based on the internal clock signal.

When the RC delay compensation mode is in an ON state, the plurality of data driver circuits DC_1, DC_2, . . . , DC_(K−1), and DC_K is configured to receive the image data DATA, the external clock signal CLK_E, and a delay difference LDS from the timing controller 200.

A first data driver circuit DC_1 is configured to receive first image data DATA_1, an external clock signal CLK_E and a delay difference LDS from the timing controller 200.

The first data driver circuit DC_1 is configured to restore the external clock signal CLK_E and to generate a first internal clock signal CLK_1. The first data driver circuit DC_1 is configured to convert the first image data DATA_1 into a plurality of first data signals 1D1, . . . , 1Dn, each of which is an analog voltage.

The first data driver circuit DC_1 is configured to determine output timings of the plurality of first data signals 1D1, . . . , 1Dn based on the first internal clock signal CLK_1 and the delay difference LDS.

The first data driver circuit DC_1 is configured to sequentially output the plurality of first data signals 1D1, . . . , 1Dn to the plurality of first data lines, which is connected to the plurality of first output channels CH1, . . . , CHn, according to the determined output timings.

The first data driver circuit DC_1 is configured to generate a first output timing signal OPS_1 corresponding to the output timing of a last n-th output channel, and to provide a second data driver circuit DC_2 that is a next data driver circuit with the first output timing signal OPS_1.

The second data driver circuit DC_2 is configured to receive second image data DATA_2, the external clock signal CLK_E, and the delay difference LDS from the timing controller 200. In addition, the second data driver circuit DC_2 is configured to receive the first output timing signal OPS_1.

The second data driver circuit DC_2 is configured to restore the external clock signal CLK_E and to generate a second internal clock signal CLK_2 delayed from the external clock signal CLK_E based on the first output timing signal OPS_1. The second data driver circuit DC_2 is configured to convert the second image data DATA_2 into a plurality of second data signals 2D1, . . . , 2Dn, each of which is an analog voltage.

The second data driver circuit DC_2 is configured to determine output timings of the plurality of second data signals 2D1, . . . , 2Dn based on the second internal clock signal CLK_2 and the delay difference LDS.

The second data driver circuit DC_2 is configured to sequentially output the plurality of second data signals 2D1, . . . , 2Dn to the plurality of second data lines, which is connected to the plurality of second output channels CH1, . . . , CHn, according to the determined output timings.

The second data driver circuit DC_2 is configured to generate a second output timing signal OPS_2 corresponding to the output timing of a last n-th output channel, and to provide a third data driver circuit DC_3 that is a next data driver circuit with the second output timing signal OPS_2.

As described above, a K-th data driver circuit DC_K is configured to receive K-th image data DATA_K, the external clock signal CLK_E, and the delay difference LDS from the timing controller 200. In addition, the K-th data driver circuit DC_K is configured to receive the (K−1)-th output timing signal OPS_(K−1). The (K−1)-th output timing signal OPS_(K−1) may correspond to an output timing of a last n-th output channel CHn of the (K−1)-th data driver circuit DC_(K−1).

The K-th data driver circuit DC_K is configured to restore the external clock signal CLK_E and to generate a K-th internal clock signal CLK_K delayed from the external clock signal CLK_E based on the (K−1)-th output timing signal OPS_(K−1). The K-th data driver circuit DC_K is configured to convert the K-th image data DATA_K into a plurality of K-th data signals KD1, . . . , KDn, each of which is an analog voltage.

The K-th data driver circuit DC_K is configured to determine output timings of the plurality of K-th data signals KD1, . . . , KDn based on the K-th internal clock signal CLK_K and the delay difference LDS.

The K-th data driver circuit DC_K is configured to sequentially output the plurality of K-th data signals KD1, . . . , KDn to the plurality of K-th data lines, which is connected to the plurality of K-th output channels CH1, . . . , CHn, according to the determined output timings.

According to the exemplary embodiment, a last output channel among a plurality of output channels of a current data driver circuit may have an output timing that is the same as that of a first output channel among a plurality of output channels of a next data driver circuit.

An output timing of a first output channel among a plurality of output channels of a current data driver circuit may be delayed from an output timing of a last output channel among a plurality of output channels of a previous data driver circuit.

According to the exemplary embodiment, in a display apparatus with a high-resolution, a plurality of data driver circuits may be configured to sequentially output all data signals through all output channels of the plurality of data driver circuits. Thus, a data charge margin, according to the RC delay of the scan signal in the display apparatus with a high-resolution, may increase.

Figure 5:
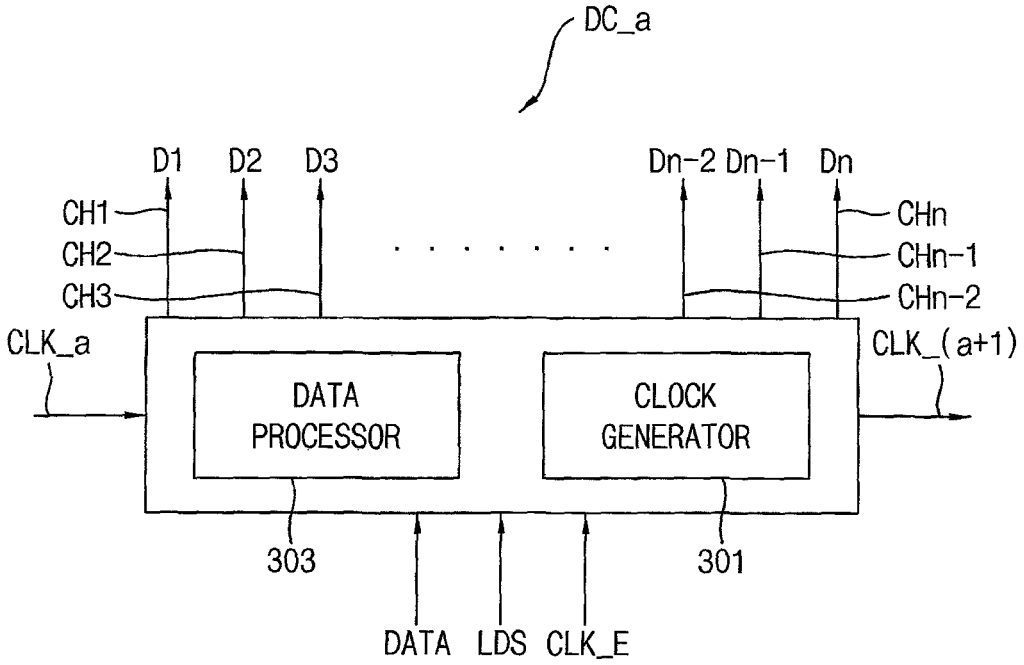
FIG. 5 is a block diagram illustrating a data driving circuit according to an exemplary embodiment of the inventive concept.

FIG. 5 is a block diagram illustrating a data driving circuit according to an exemplary embodiment of the inventive concept.

Referring to FIGS. 1 and 5, the data driver circuit DC_a may include a clock generator 301 and a data processor 303.

The data driver circuit DC_a is configured to receive image data DATA, an external synchronizing signal CLK_E and a delay difference LDS from the timing controller 200 using a set or predetermined interface mode, such as an LVDS mode. Hereinafter, the external synchronizing signal may be referred to as an external clock signal. The delay difference LDS may be determined by the timing controller 200.

When the data driver circuit DC_a is a first data driver circuit among the plurality of data driver circuits, the data driver circuit DC_a is configured to receive the image data DATA, the external clock signal CLK_E, and the delay difference LDS from the timing controller 200. The data driver circuit DC_a is configured not to receive a feedback signal that is an output timing signal OPS_(a−1) from a previous data driver circuit (wherein, 'a' is a natural number).

For example, the data driver circuit DC_a is configured to restore the external clock signal CLK_E and to generate an internal clock signal CLK_a using the external clock signal CLK_E.

The data processor 303 is configured to convert the image data DATA into a data signal, each of which is an analog voltage.

The data processor 303 is configured to determine output timings of the plurality of data signals D1, D2, D3, . . . , Dn−2, Dn−1, and Dn based on the internal clock signal CLK_a and the delay difference LDS.

The data processor 303 is configured to sequentially output the plurality of data signals D1, D2, D3, . . . , Dn−2, Dn−1, and Dn to the plurality of data lines, which is connected to the plurality of output channels CH1, CH2, CH3, . . . , CHn−2, CHn−1, and CHn, according to the determined output timings.

For example, the data processor 303 is configured to time-share a delay period corresponding to the delay difference LDS by a number of the output channels and to sequentially provide the plurality of data signals D1, D2, D3, . . . , Dn−2, Dn−1, and Dn at the time-shared output timings.

The clock generator 301 is configured to generate an internal clock signal CLK_(a+1) of a next data driver circuit delayed by a set or predetermined period from the internal clock signal CLK_a based on the delay difference LDS. The clock generator 301 is configured to provide the next data driver circuit with the internal clock signal CLK_(a+1).

However, when the data driver circuit DC_a is not the first data driver circuit among the plurality of data driver circuits, the data driver circuit DC_a is configured to receive the image data DATA, the external clock signal CLK_E, and the delay difference LDS from the timing controller 200. In addition, the data driver circuit DC_a is configured to receive an internal clock signal CLK_a that is the feedback signal outputted from a previous data driver circuit. The internal clock signal CLK_a may correspond to a main clock signal for driving the data driver circuit DC_a.

The data processor 303 is configured to convert the image data DATA into the data signal, which is an analog voltage.

The data processor 303 is configured to determine output timings of the plurality of data signals D1, D2, D3, . . . , Dn−2, Dn−1, and Dn based on the internal clock signal CLK_a and the delay difference LDS.

The data processor 303 is configured to sequentially output the plurality of data signals D1, D2, D3, . . . , Dn−2, Dn−1, and Dn to the plurality of data lines, which is connected to the plurality of output channels CH1, CH2, CH3, . . . , CHn−2, CHn−1, and CHn, according to the determined output timings.

For example, the data processor 303 is configured to time-share a delay period corresponding to the delay difference LDS by a number of the output channels and to sequentially provide the plurality of data signals D1, D2, D3, . . . , Dn−2, Dn−1, and Dn at the time-shared output timings.

The clock generator 301 is configured to generate an internal clock signal CLK_(a+1) of a next data driver circuit delayed by a set or predetermined period from the internal clock signal CLK_a based on the delay difference LDS. The clock generator 301 is configured to provide the next data driver circuit with the internal clock signal CLK_(a+1).

Figure 6:
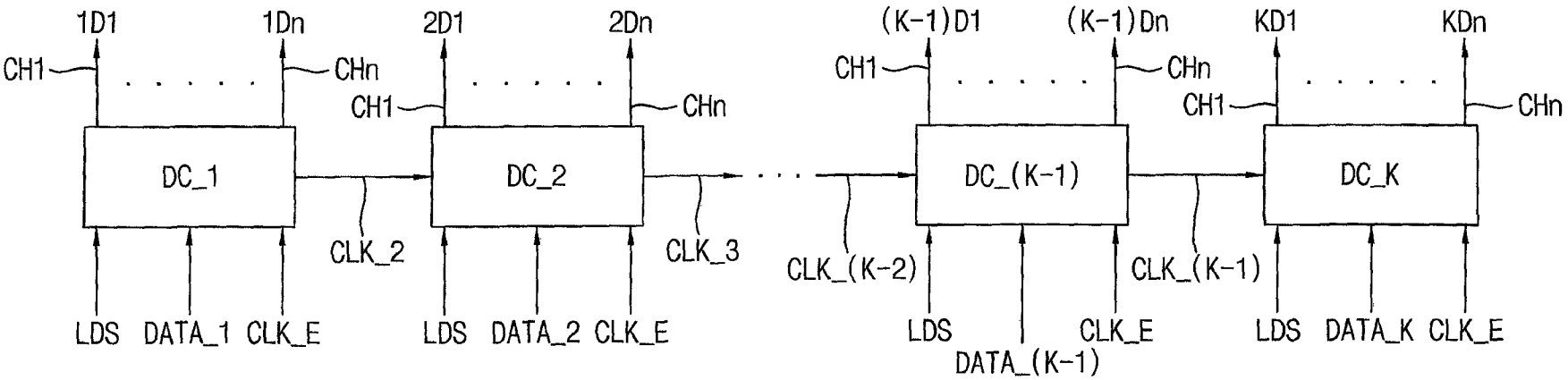
FIG. 6 is a block diagram illustrating a plurality of data driving circuits according to an exemplary embodiment of the inventive concept.

FIG. 6 is a block diagram illustrating a plurality of data driving circuits according to an exemplary embodiment of the inventive concept.

Referring to FIGS. 4 and 6, the display apparatus may include a plurality of data driver circuits DC_1, DC_2, . . . , DC_(K−1), and DC_K (wherein, 'K' is a natural number).

When an RC delay compensation mode is in an OFF state, the plurality of data driver circuits DC_1, DC_2, . . . , DC_(K−1), and DC_K is configured to receive image data DATA and an external clock signal CLK_E from the timing controller 200.

Each of the plurality of data driver circuits DC_1, DC_2, . . . , DC_(K−1), and DC_K is configured to restore the external clock signal CLK_E, to generate an internal clock signal using the external clock signal CLK_E, and to concurrently (e.g., simultaneously) output the plurality of data signals (e.g., at a same time or at a same output timing) based on the internal clock signal.

When the RC delay compensation mode is in an ON state, the plurality of data driver circuits DC_1, DC_2, . . . , DC_(K−1), and DC_K is configured to receive the image data DATA, the external clock signal CLK_E, and a delay difference LDS from the timing controller 200.

A first data driver circuit DC_1 is configured to restore the external clock signal CLK_E and to generate a first internal clock signal CLK_1. The first data driver circuit DC_1 is configured to convert the first image data DATA_1 into a plurality of first data signals 1D1, . . . , 1Dn, each of which is an analog voltage.

The first data driver circuit DC_1 is configured to determine output timings of the plurality of first data signals 1D1, . . . , 1Dn based on the first internal clock signal CLK_1 and the delay difference LDS.

The first data driver circuit DC_1 is configured to sequentially output the plurality of first data signals 1D1, . . . , 1Dn to the plurality of first data lines, which is connected to the plurality of first output channels CH1, . . . , CHn, according to the determined output timings.

The first data driver circuit DC_1 is configured to generate a second internal clock signal CLK_2 of a second data driver circuit delayed by a set or predetermined period form the internal clock signal CLK_a based on the delay difference LDS. The clock generator 301 is configured to provide the second data driver circuit with the second internal clock signal CLK_2.

The second data driver circuit DC_2 is configured to receive the image data DATA, the external clock signal CLK_E, and the delay difference LDS from the timing controller 200. In addition, the second data driver circuit DC_2 is configured to receive the second internal clock signal CLK_2 from the first data driver circuit DC1.

The second data driver circuit DC_2 is configured to convert the image data DATA into the data signal, each of which is an analog voltage.

The second data driver circuit DC_2 is configured to determine output timings of the plurality of second data signals 2D1, . . . , 2Dn based on the second internal clock signal CLK_2 and the delay difference LDS.

The second data driver circuit DC_2 is configured to sequentially output the plurality of second data signals 2D1, . . . , 2Dn to the plurality of second data lines, which is connected to the plurality of second output channels CH1, . . . , CHn, according to the determined output timings.

The second data driver circuit DC_2 is configured to generate a third internal clock signal CLK_3 of a third data driver circuit DC_3 delayed by the set or predetermined period from the second internal clock signal CLK_2 based on the delay difference LDS. The second data driver circuit DC_2 is configured to provide the third data driver circuit DC_3 with the third internal clock signal CLK_3.

As described above, a K-th data driver circuit DC_K is configured to receive K-th image data DATA_K, the external clock signal CLK_E, and the delay difference LDS from the timing controller 200. In addition, the K-th data driver circuit DC_K is configured to receive the K-th internal clock signal CLK_K from the (K−1)-th data driver circuit DC_(K−1).

The K-th data driver circuit DC_K is configured to convert the K-th image data DATA_K into a plurality of K-th data signals KD1, . . . , KDn, each of which is an analog voltage.

The K-th data driver circuit DC_K is configured to determine output timings of the plurality of K-th data signals KD1, . . . , KDn based on the K-th internal clock signal CLK_K and the delay difference LDS.

The K-th data driver circuit DC_K is configured to sequentially output the plurality of K-th data signals KD1, . . . , KDn to the plurality of K-th data lines, which is connected to the plurality of K-th output channels CH1, . . . , CHn, according to the determined output timings.

The K-th data driver circuit DC_K is configured to generate a (K+1)-th internal clock signal CLK_(K+1) of a (K+1)-th data driver circuit DC_(K+1) delayed by the set or predetermined period from the K-th internal clock signal CLK_K based on the delay difference LDS. The K-th data driver circuit DC_K is configured to provide the (K+1)-th data driver circuit DC_(K+1) with the (K+1)-th internal clock signal CLK_(K+1).

According to the exemplary embodiment, a last output channel among a plurality of output channels of a current data driver circuit may have an output timing that is the same as that of a first output channel among a plurality of output channels of a next data driver circuit.

An output timing of a first output channel among a plurality of output channels of a current data driver circuit may be delayed from an output timing of a last output channel among a plurality of output channels of a previous data driver circuit.

According to the exemplary embodiment, in a display apparatus with a high-resolution, a plurality of data driver circuits may be configured to sequentially output all data signals through all output channels of the plurality of data driver circuits. Thus, a data charge margin, according to the RC delay of the scan signal in the display apparatus with a high-resolution, may increase.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components according to embodiments of the present invention described herein, such as the scan driver, the first data driver circuit and the second data driver circuit, may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of the inventive concept and is not to be construed as limiting thereof. Although a few exemplary embodiments of the inventive concept have been described, those skilled in the art will readily appreciate that many suitable modifications are possible in the exemplary embodiments without materially departing from the novel teachings and advantages of the inventive concept. Accordingly, all such modifications are intended to be included within the scope of the inventive concept as defined by the claims, and equivalents thereof. In the claims, means-plus-function clauses are intended to cover the structures described herein as performing the recited function and also equivalent structures. The inventive concept is defined by the following claims, with equivalents of the claims to be included therein.

What is claimed is:

1. A display apparatus comprising:

a display panel comprising a plurality of data lines and a plurality of scan lines crossing the plurality of data lines, the plurality of data lines comprising a plurality of first data lines and a plurality of second data lines;

a scan driver configured to sequentially output a plurality of scan signals to the plurality of scan lines;

a first data driver circuit configured to sequentially output a plurality of first data signals to the plurality of first data lines; and a second data driver circuit configured to sequentially output a plurality of second data signals to the plurality of second data lines based on a feedback signal received from the first data driver circuit; and a timing controller, wherein each of the first and second data driver circuits comprises a plurality of output channels, and the timing controller is configured to provide each of the first and second data driver circuits with a delay difference between output signals of a first output channel and a last output channel from among the plurality of output channels, and wherein the first data driver circuit is configured:

to generate a first internal clock signal based on an external clock signal, to sequentially output a plurality of first data signals based on the first internal clock signal and the delay difference, and to supply the second data driver circuit with the feedback signal corresponding to an output timing of a last first data signal from among the plurality of first data signals, the feedback signal being for generating a second internal clock signal used in the second data driver circuit.

2. The display apparatus of claim 1, wherein the second data driver circuit is configured:

to generate the second internal clock signal delayed from an external clock signal based on the feedback signal, to sequentially output a plurality of second data signals based on the second internal clock signal and the delay difference, and to output the feedback signal corresponding to an output timing of a last second data signal from among the plurality of second data signals.

3. The display apparatus of claim 1, wherein each of the first and second data driver circuits comprises:

a clock generator configured to generate an internal clock signal; and a data processor configured to convert image data into a data signal that is an analog voltage.

4. The display apparatus of claim 1, wherein a last output channel from among a plurality of output channels of the first data driver circuit is configured to output a data signal at an output timing that is the same as that of a first output channel from among a plurality of output channels of the second data driver circuit.

5. A display apparatus comprising:

a display panel comprising a plurality of data lines and a plurality of scan lines crossing the plurality of data lines, the plurality of data lines comprising a plurality of first data lines and a plurality of second data lines;

a scan driver configured to sequentially output a plurality of scan signals to the plurality of scan lines;

a first data driver circuit configured to sequentially output a plurality of first data signals to the plurality of first data lines;

a second data driver circuit configured to sequentially output a plurality of second data signals to the plurality of second data lines based on a feedback signal received from the first data driver circuit; and a timing controller, wherein each of the first and second data driver circuits comprises a plurality of output channels, and the timing controller is configured to provide each of the first and second data driver circuits with a delay difference between output signals of a first output channel and a last output channel from among the plurality of output channels, and wherein the first data driver circuit is configured:

to generate a first internal clock signal based on an external clock signal, to sequentially output a plurality of first data signals based on the first internal clock signal and the delay difference, to generate a second internal clock signal delayed from the first internal clock signal based on the delay difference, and to output the feedback signal as the second internal clock signal.

6. The display apparatus of claim 5, wherein the second data driver circuit is configured:

to sequentially output a plurality of second data signals based on the second internal clock signal, to generate a third internal clock signal delayed from the second internal clock signal based on the delay difference, and to output the feedback signal as the third internal clock signal.

7. A method of driving a display apparatus that comprises a plurality of data lines and a plurality of scan lines crossing the plurality of data lines, the method comprising:

outputting a scan signal to the plurality of scan lines;

sequentially outputting a plurality of first data signals to a plurality of first data lines by a first data driver circuit;

sequentially outputting a plurality of second data signals to a plurality of second data lines, based on a feedback signal received from the first data driver circuit, by a second data driver circuit, the plurality of second data signals being delayed from the plurality of first data signals;

supplying each of the first and second data driver circuits with a delay difference between output signals of a first output channel and a last output channel from among a plurality of output channels, wherein each of the first and second data driver circuits comprises a plurality of output channels;

generating a first internal clock signal, by the first data driver circuit, based on an external clock signal;

sequentially outputting a plurality of first data signals based on the first internal clock signal and the delay difference; and supplying, to the second data driver circuit, the feedback signal corresponding to an output timing of a last first data signal from among the plurality of first data signals, the feedback signal being for generating a second internal clock signal used in the second data driver circuit.

8. The method of claim 7, further comprising:

generating the second internal clock signal, by the second data driver circuit, that is delayed from an external clock signal based on the feedback signal;

sequentially outputting a plurality of second data signals based on the second internal clock signal and the delay difference; and outputting the feedback signal corresponding to an output timing of a last second data signal from among the plurality of second data signals.

9. The method of claim 7, wherein a last output channel from among a plurality of output channels of the first data driver circuit is configured to output a data signal at an output timing that is the same as that of a first output channel from among a plurality of output channels of the second data driver circuit.

10. A method of driving a display apparatus that comprises a plurality of data lines and a plurality of scan lines crossing the plurality of data lines, the method comprising:

outputting a scan signal to the plurality of scan lines;

sequentially outputting a plurality of first data signals to a plurality of first data lines by a first data driver circuit;

sequentially outputting a plurality of second data signals to a plurality of second data lines, based on a feedback signal received from the first data driver circuit, by a second data driver circuit, the plurality of second data signals being delayed from the plurality of first data signals;

supplying each of the first and second data driver circuits with a delay difference between output signals of a first output channel and a last output channel from among a plurality of output channels, wherein each of the first and second data driver circuits comprises a plurality of output channels;

generating a first internal clock signal, by the first data driver circuit, based on an external clock signal;

sequentially outputting a plurality of first data signals based on the first internal clock signal and the delay difference;

generating a second internal clock signal delayed from the first internal clock signal based on the delay difference; and outputting the second internal clock signal as the feedback signal to the second data driver circuit.

11. The method of claim 10, further comprising:

sequentially outputting a plurality of second data signals based on the second internal clock signal;

generating a third internal clock signal delayed from the second internal clock signal based on the delay difference; and outputting the feedback signal as the third internal clock signal.

* * * * *